US005803726A

United States Patent [19]

Bacon

[11] Patent Number: 5,803,726

[45] Date of Patent: Sep. 8, 1998

[54] RETRACTABLE, ELECTRIC ARC-IGNITED GAS PILOT FOR IGNITING FLARE STACKS

[76] Inventor: David W. Bacon, Rt. 1, 908 Cardinal La., Paige, Tex. 78659-9741

[21] Appl. No.: 726,025

[22] Filed: Oct. 4, 1996

[51] Int. Cl.[6] ..... F23D 13/20

[52] U.S. Cl. ..... 431/202; 431/264

[58] Field of Search ..... 431/264, 202, 431/5

[56] References Cited

U.S. PATENT DOCUMENTS

| | | | |
|---|---|---|---|
| 4,147,493 | 4/1979 | Straitz, III | 431/202 |
| 4,147,498 | 4/1979 | Clarke | 431/202 |
| 4,255,120 | 3/1981 | Straitz | 431/202 |
| 4,269,583 | 5/1981 | Straitz | 431/202 |
| 4,579,522 | 4/1986 | MacDonald | 431/202 |
| 5,291,367 | 3/1994 | Rajewski | 361/253 |
| 5,380,195 | 1/1995 | Reid et al. | 431/202 |
| 5,429,496 | 7/1995 | Stephens et al. | 431/202 |

OTHER PUBLICATIONS

Tornado Flare Systems –Brochure –Arch Light (No Date).

Tornado Flare Systems (No Date).

*Primary Examiner*—Carl D. Price
*Attorney, Agent, or Firm*—Derek R. Van Gilder

[57] ABSTRACT

A retractable, electric arc-ignited, gas pilot for igniting flare stacks is comprised of an upper support and guide assembly fixed to the upper end of said flare stack. Two guide cables and a pulley are fixed to the upper support and guide assembly. The two guide cables are fixed to a tension beam. The tension beam and a winch are fixed to a winch foundation plate. The winch foundation plate is fixed near the lower end of the flare stack. A draw cable is fixed to the drum of the winch and the draw cable extends to the pulley and is disposed around the pulley wherein the draw cable is fixed to a pilot carriage assembly. The pilot carriage assembly is guided on the guide cables and is raised by the winch and draw cable and is lowered by gravity. The pilot carriage assembly supports a gas line charged with combustible gas and an ignition system comprised of a coil, a high voltage wire, a spark plug and a thermocouple. During normal operating conditions, the pilot carriage assembly remains at the top of the flare stack. Combustible gas is always flowing through the gas nozzle where it is ignited by a spark plug. An ignition coil is energized by the control system every two (2) seconds, thus creating a spark in the pilot nozzle every two (2) seconds. Therefore, a "Standing Flame" is always present at the pilot nozzle and provides an ignition source for the disposable gases being discharged at the top of the flare. If the "Standing Flame" is extinguished, it is automatically reignited every two (2) seconds.

To perform maintenance on the ignition system or combustion system of the retractable, electric arc-ignited gas pilot system, the pilot carriage assembly is lowered to near the bottom end of the flare stack for easy and safe access.

2 Claims, 9 Drawing Sheets

RETRACTABLE, ELECTRIC ARC-IGNITED GAS PILOT FOR IGNITING FLARE STACKS

BACKGROUND OF THE INVENTION

There are several types of flare stack ignition systems that are in use today. One such design is shown in a patent issued to Stephens et. al. on Jul. 4, 1995, U.S. Pat. No. 5,429,496. To lower the Stephens flare boom, a space must be provided that is the length of the flare stack itself. If in the case of a flare stack of one hundred feet in height, the ignition portable flare boom must also be over one hundred feet tall. One hundred feet of unrestricted and clear space from the base of the flare stack is also necessary. This is frequently not the case in chemical plants, refineries or drilling and production sites which often had numerous other pieces of equipment in the vicinity.

Other flare ignition systems that may be used are: Clark U.S. Pat. No. 4,147,498 issued on Apr. 3, 1979; Reid et. al. U.S. Pat No. 5,380,195 issued on Jan 10, 1995; Straitz U.S. Pat. No. 4,269,583 issued on May 26, 1981; Straitz U.S. Pat. No. 4,255,120 issued on Mar. 10, 1981.

Most of these designs work well, however, they do not render easy access for maintenance especially while the flare stack is burning combustible waste gases.

SUMMARY

It is an object of this invention to provide an electric arc-ignited gas pilot for igniting flare stacks that is retractable to grade for easy maintenance and upgrading even while the flare stack is in a combustion mode and flaring gases.

Another object of the present invention is to provide a flare stack ignition system for safe and easy installation on an existing flare stack.

It is yet another object of the present invention to provide cables as a pilot guide which are not as prone to damage due to heat, corrosion or other external environmental forces.

It is yet another object of the present invention to provide a flare stack ignition system that will provide low fuel consumption with dependability.

The foregoing and other objects and advantages are attained by an upper support and guide assembly suitably fixed to the upper end of the flare stack and a pilot carriage assembly containing a pilot carriage assembly that moves up and down the flare stack on a first guide cable and a second guide cable while using a draw cable to pull the pilot carriage assembly up and down the flare stack.

DETAILED DESCRIPTION OF THE PREFERRED EMBODIMENTS

Figure 1:
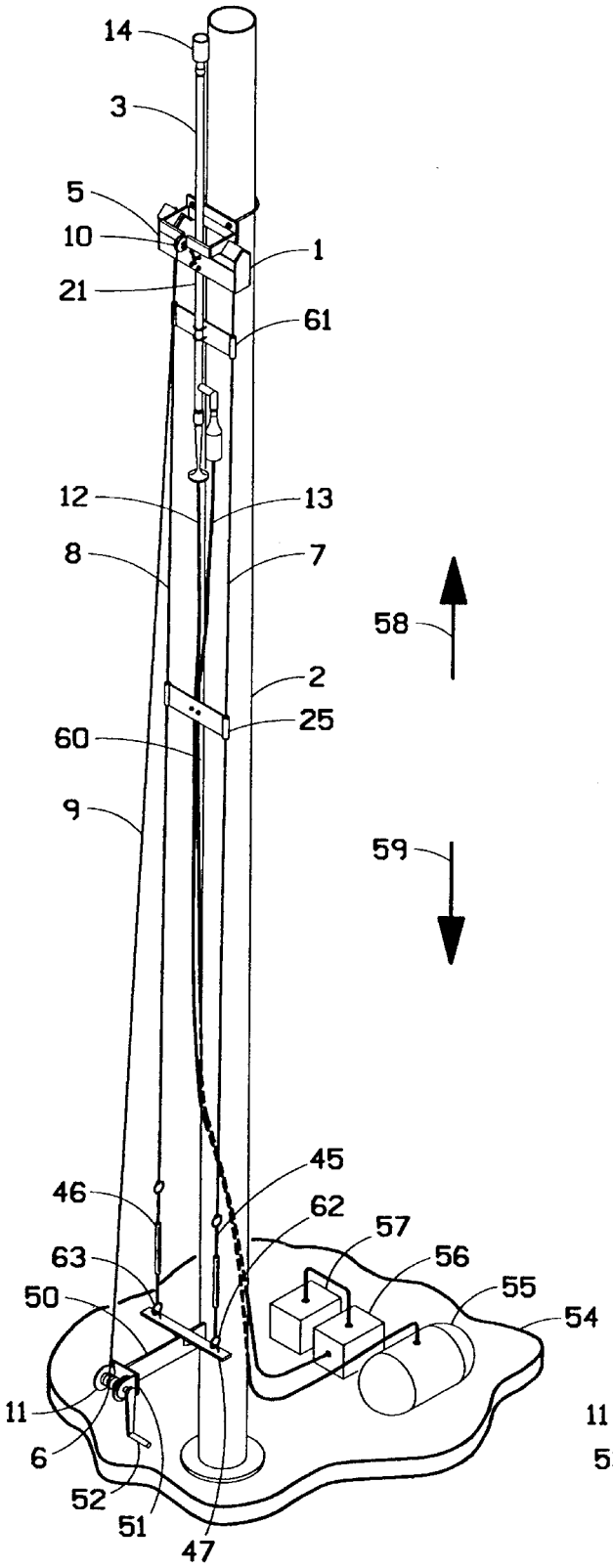
FIG. 1 is an elevation view of the device on a flare stack in a operational flare ignition position.

Referring to FIG. 1 there is shown an elevation view of a device 1 on a flare stack 2 in an operational flare ignition position. A pilot assembly 3 is elevated to where a pilot shield 14 is near the top of the flare stack 2. The pilot shield 14 may be below the top of the flare stack 2 or above the top of the flare stack 2 by design choice. The pilot shield 14 is supported by and is suitably fixed to a first end of a pilot gas conductor 21. The pilot gas conductor 21 is shown suitably fixed to a pilot carriage assembly 5 by 'U' bolts not seen in this view. The pilot gas conductor 21 of the pilot assembly 3 is further suitably fixed to a bundle guide 25. The bundle guide 25, guides the pilot assembly 3 on a first guide cable 7 and the second guide cable 8 while the pilot assembly 3 and the pilot carriage assembly 5 are being elevated 58 or lowered 59 and maintains control of the pilot assembly 3 in high winds.

A gas tube 12 and ignition and control conductors 13 are shown suitably joined together in a conductor bundle 60 that will allow for safer control of all of the conductors in high winds.

The conductor bundle 60 is further controlled during elevating and lowering operations and in high winds by at least one bundle guide 25 that is similar to an upper guide 61. The gas tube 12 and the ignition and control conductors 13 in the conductor bundle 60 are again separate near the lower end of the flare stack 2. The gas tube 12 is connected to a gas container 55 or has another supply system. The ignition and control conductors 13 are connected to a control module 56 and a power supply 57.

A winch assembly 6 is shown near the lower end of the flare stack 2. A winch foundation plate 50 is shown suitably fixed to the flare stack 2 by welding, but 'U' bolts or other attachment means could be used by design choice. A winch bolt support plate 51 is shown suitably fixed to the winch foundation plate 50 by welding. The winch 11 is bolted to the winch foundation plate 50, however, it could be welded by design choice. A winch drum is not seen clearly in this view however because it is covered with a draw cable 9. The draw cable 9 extends from the winch 11 to a pulley 10, wherein the draw cable 9 is dropped over the pulley 10 where a draw cable loop is formed which is further disposed in a draw cable eye of the pilot carriage assembly 5.

A tensioner beam 47 is shown suitably fixed to the upper end of the winch foundation plate 50 by welding or other suitable means. A first cable tensioner 45 is shown suitably fixed to a first tensioner eye 62 at a first end of the tensioner beam 47, while a second cable tensioner 46 is shown suitably fixed to a second tensioner eye 63 at the second end of the tensioner beam 47. A second end of the first guide cable 7 is suitably fixed to the first end of the first cable tensioner 45, and the second end of the second guide cable 8 is shown suitably fixed to the first end of the second cable tensioner 46.

To elevate the pilot assembly 3 and the pilot carriage assembly 5, a winch handle 52 is cranked in one direction, and to lower the pilot assembly 3 and the pilot carriage assembly 5, the winch handle 52 is cranked in the opposite direction. A brake means or a holding means is also incorporated onto the winch 11 to hold the pilot assembly 3 and the pilot carriage assembly 5 in place once elevated, is not shown, but is inside of the winch 11.

Figure 2:
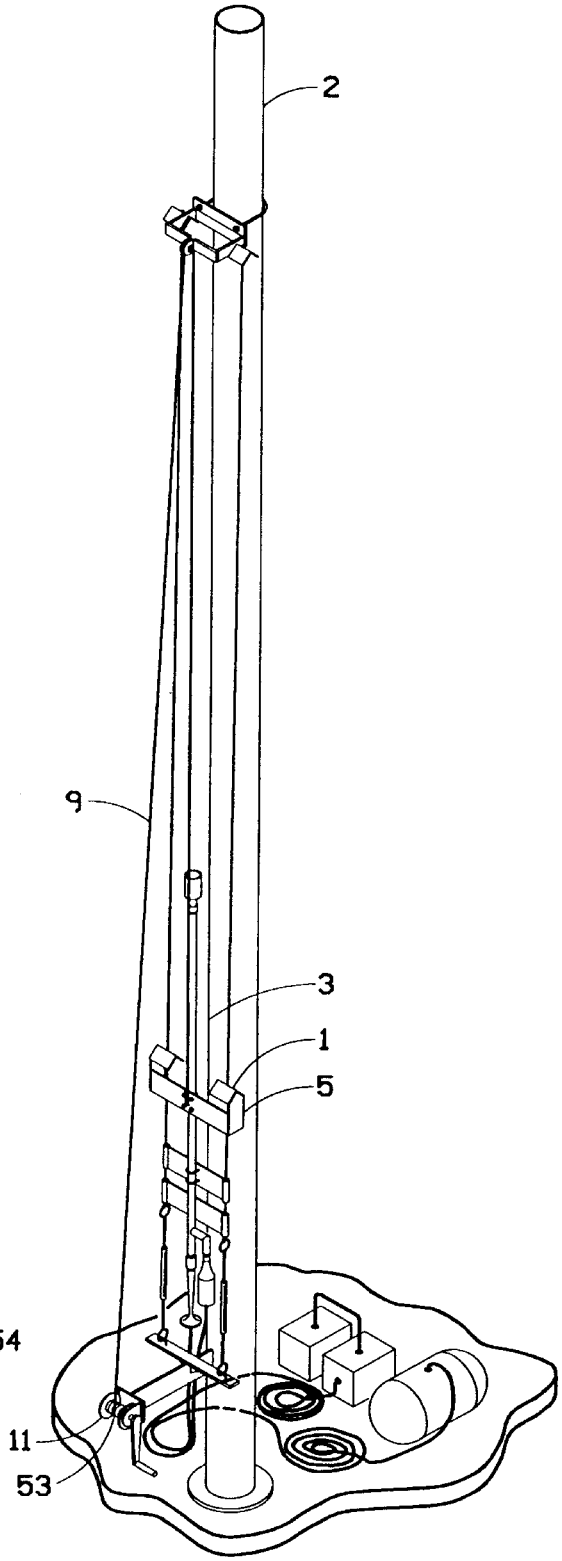
FIG. 2 is an elevation view of the device on a flare stack in a maintenance position.

Referring to FIG. 2 there is shown an elevation view of the flare stack 2 and the device 1 lowered to the lower end of the flare stack 2 in a maintenance position. The winch 11, brake has been released and the winch drum 53 has been rotated in the necessary direction to allow the draw cable 9 to lower the pilot carriage assembly 5 and the pilot assembly 3 to the lower end of the flare stack 2.

Figure 3:
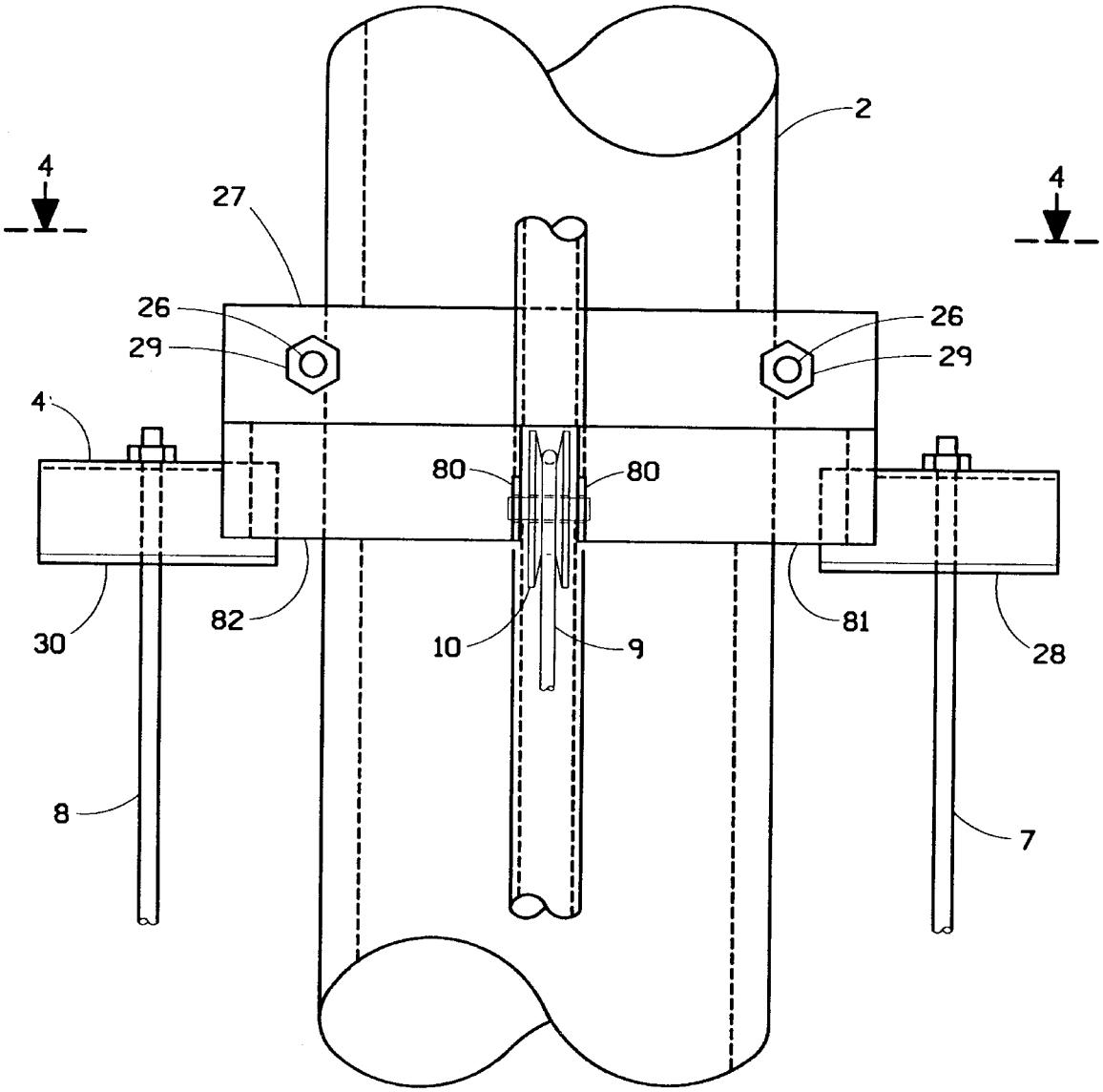
FIG. 3 is an elevation view of the upper support and guide assembly.

Referring to FIG. 3 there is shown an elevation view of an upper support and guide assembly 4. The first end of the first guide cable 7 is shown suitably fixed to a first to a first cable support means 28. The first end of the second guide cable 8 is shown suitably fixed to a second cable support means 30. The first cable support means 28 and the second cable support means 30 are shown suitably fixed to an upper support frame 27 by welding or other suitable means. The upper support frame 27 is suitably fixed to the upper end of the flare stack 2 by a first 'U' bolt 26 and nuts 29, or other suitable means. A first cable support bracket 81 is shown suitably supporting the first cable support means 28 near the second end of the first cable support means 28. The second cable support means 30 is shown suitably supported by a second cable support bracket 82 suitably fixed the first end of the second cable support means 30. The upper support frame 27 is shown supporting pulley extension brackets 80 which suitably support the pulley 10 that also suitably supports the draw cable 9.

Figure 4:
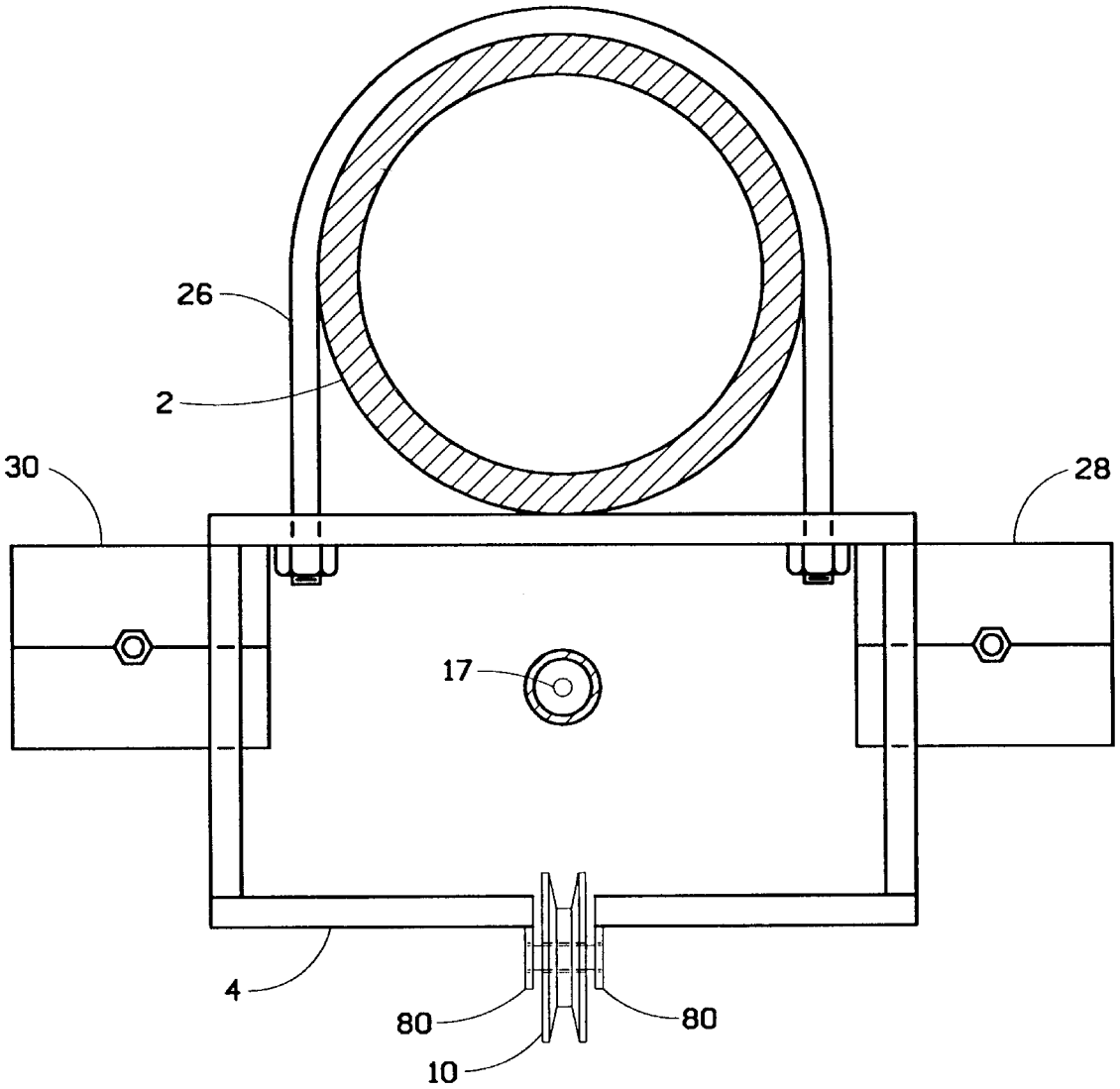
FIG. 4 is a section plan view of the upper support and guide assembly as taken through FIG. 3.

Referring to FIG. 4 there is shown a section plan view of the upper support and guide assembly 4 suitably fixed to the upper end of the flare stack 2 as taken through FIG. 3. The first 'U' bolt 26 is shown disposed around the flare stack 2 and further disposed through holes formed in the first end of the upper support and guide assembly 4. The pulley 10 is shown suitably fixed to the second end of the upper support and guide assembly 4. The first end of the first cable support means 28 is shown suitably fixed to the pulley extension brackets 80 which are also suitably fixed the third end of the upper support and guide assembly 4. The second cable support means 30 is shown suitably fixed to the fourth end of the upper support and guide assembly 4. The draw cable is not shown on the pulley 10 for clarity. A high voltage rod 17 is shown disposed in the upper support and guide assembly 4.

Figure 5:
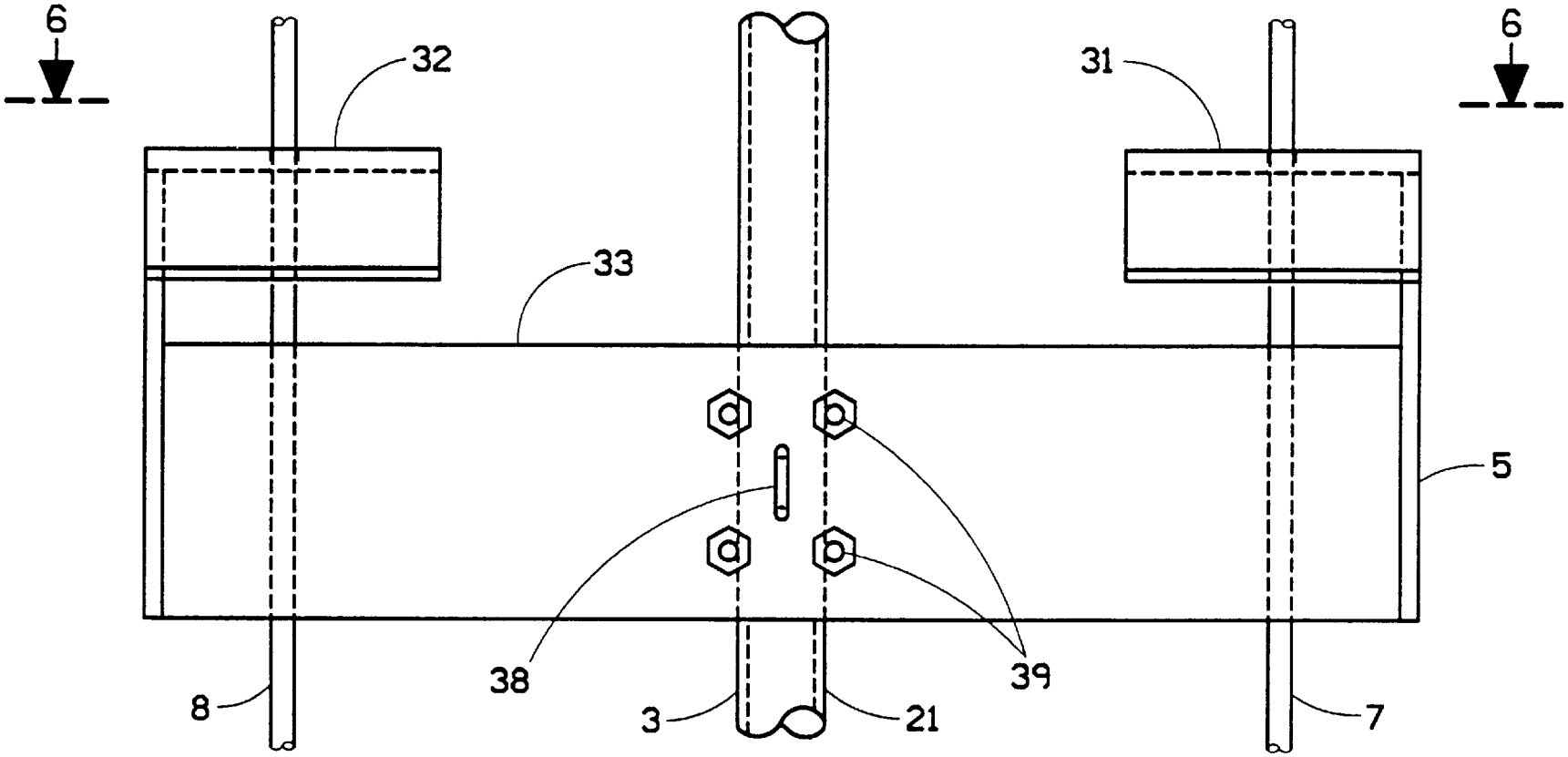
FIG. 5 is an elevation view of the pilot carriage assembly.

Referring to FIG. 5 there is shown an elevation view of the pilot carriage assembly 5. The pilot carriage assembly 5 both guides and elevates the pilot assembly 3. A first carriage guide means 31 is suitably fixed on the upper side and the first end of the pilot carriage assembly 5. A second carriage guide means 32 suitably fixed on the upper side and the second end of the pilot carriage assembly 5. The first carriage guide means 31 has a hole formed wherein the first guide cable 7 is disposed in said hole formed in said first carriage guide means 31 in the upper side and the first end of the pilot carriage assembly 5. The second carriage guide means 32 has a hole formed wherein the second guide cable 8 is disposed in the hole formed in the second carriage guide means 32 in the upper side and the second end of the pilot carriage assembly 5. A carriage support frame 33 is fixed to the first end of the pilot carriage assembly 5 and extends and is fixed to the second end of the pilot carriage assembly 5. A draw cable eye 38 is also fixed near the center of said carriage support frame 33 and a draw cable loop is disposed and fixed to the draw cable eye 38. The pilot assembly 3 with the gas conductor 21 is fixed to said carriage support frame by 'U' bolts 39.

Figure 6:
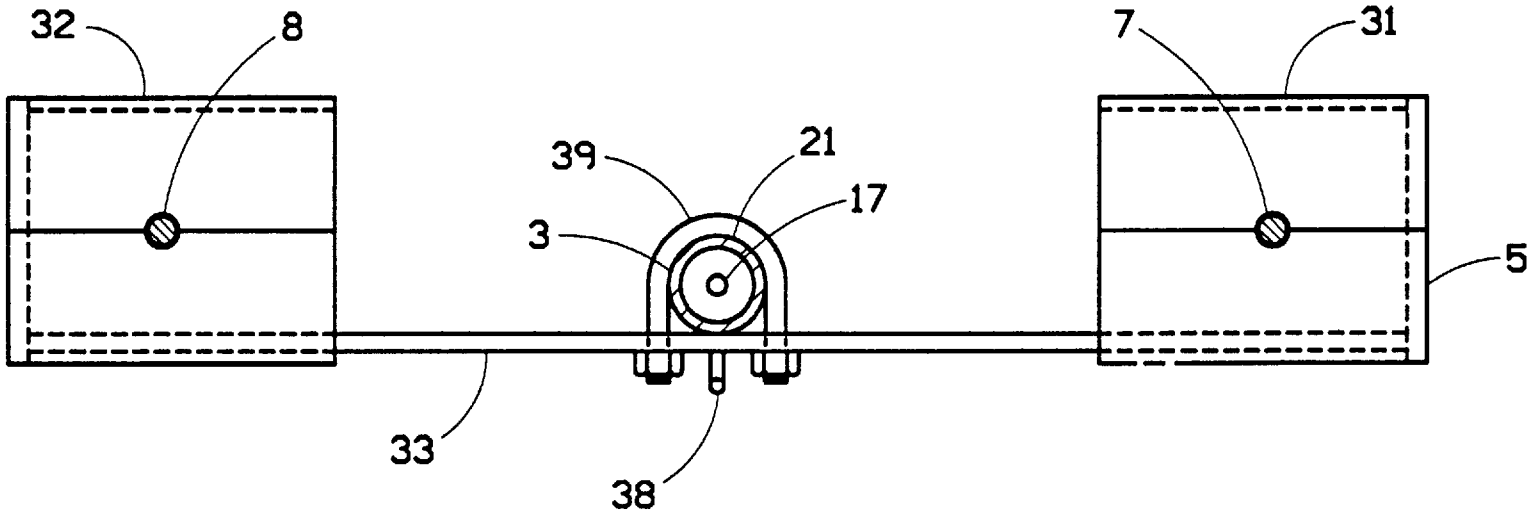
FIG. 6 is a plan view of the pilot carriage assembly.

Referring to FIG. 6 there is shown plan view of the pilot carriage assembly 5. The first carriage guide means 31 with a first end and a second end and the second carriage guide means 32 with a first end and a second end are shown with a hole formed near the center of each carriage guide means and the first guide cable 7 and the second guide cable 8 are shown disposed in the holes. The draw cable eye 38 is shown suitably fixed to the carriage support frame 33. The gas conductor 21 that is part of the pilot assembly 3 is shown suitably fixed to the carriage support frame 33 by one of the 'U' bolts 39. The high voltage rod 17 is shown near the center of the gas conductor 21.

Figure 7:
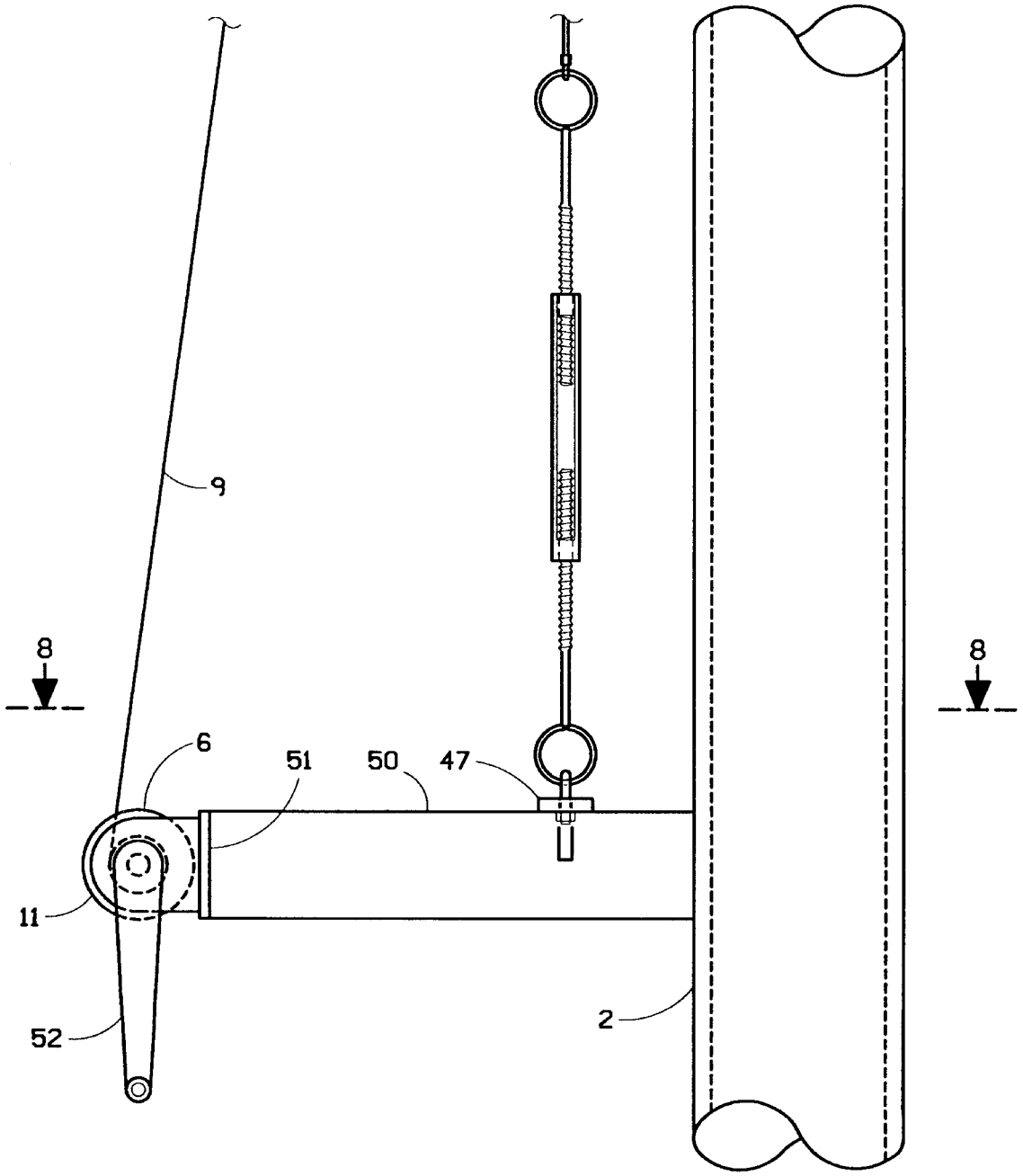
FIG. 7 is an elevation view of the winch assembly.

Referring to FIG. 7 there is shown an elevation view of the winch assembly 6. The winch 11 is shown fixed to the winch bolt support plate 51. The winch bolt support plate 51 is shown fixed by welding or other suitable means to the winch foundation plate 50 that is suitably fixed to the flare stack 2 by welding or other suitable means. The tensioner beam 47 is shown fixed to the winch foundation plate 50. The winch handle 52 is shown as part of the winch 11. The draw cable 9 is shown extending from the winch 11.

Figure 8:
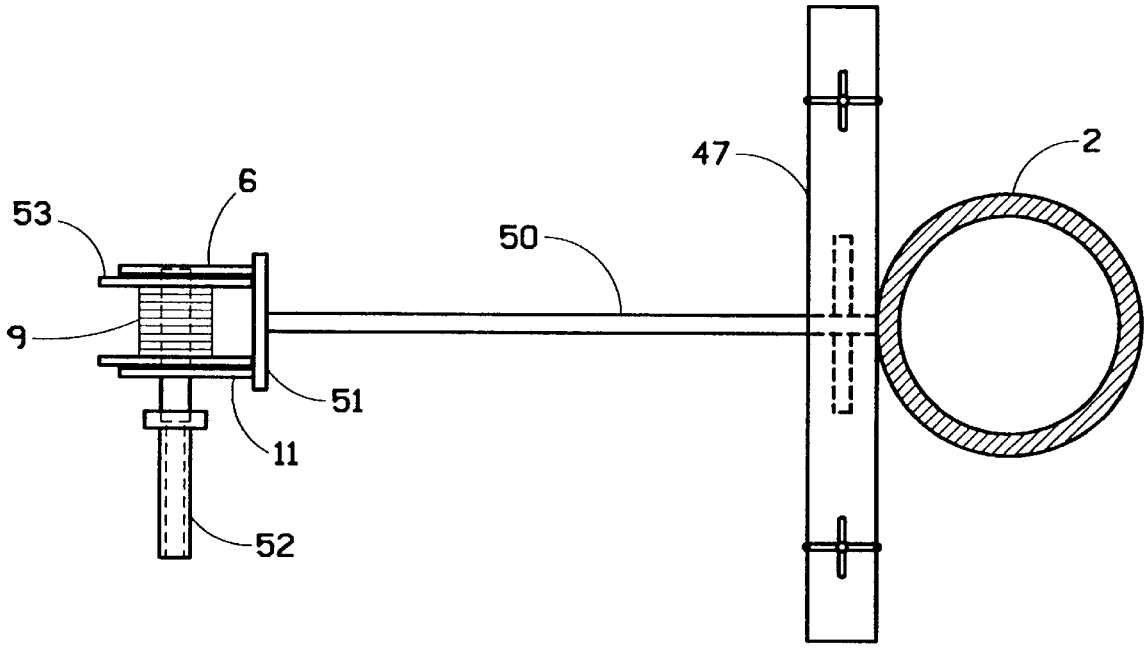
FIG. 8 is a section plan view of the winch assembly as taken through FIG. 7.

Referring to FIG. 8 there is shown a section plan view of the winch assembly 6 as taken through FIG. 7. The winch drum 53 is shown in the winch 11 and the draw cable 9 is shown disposed around the winch drum 53. The winch handle 52 is shown suitably connected to the winch drum 53. The winch 11 is shown bolted to the winch bolt support plate 51 that is fixed to the winch foundation plate 50 that is fixed to the flare stack 2. The tensioner beam 47 with a first end and a second end is shown suitably fixed to the winch foundation plate 50.

Figure 9:
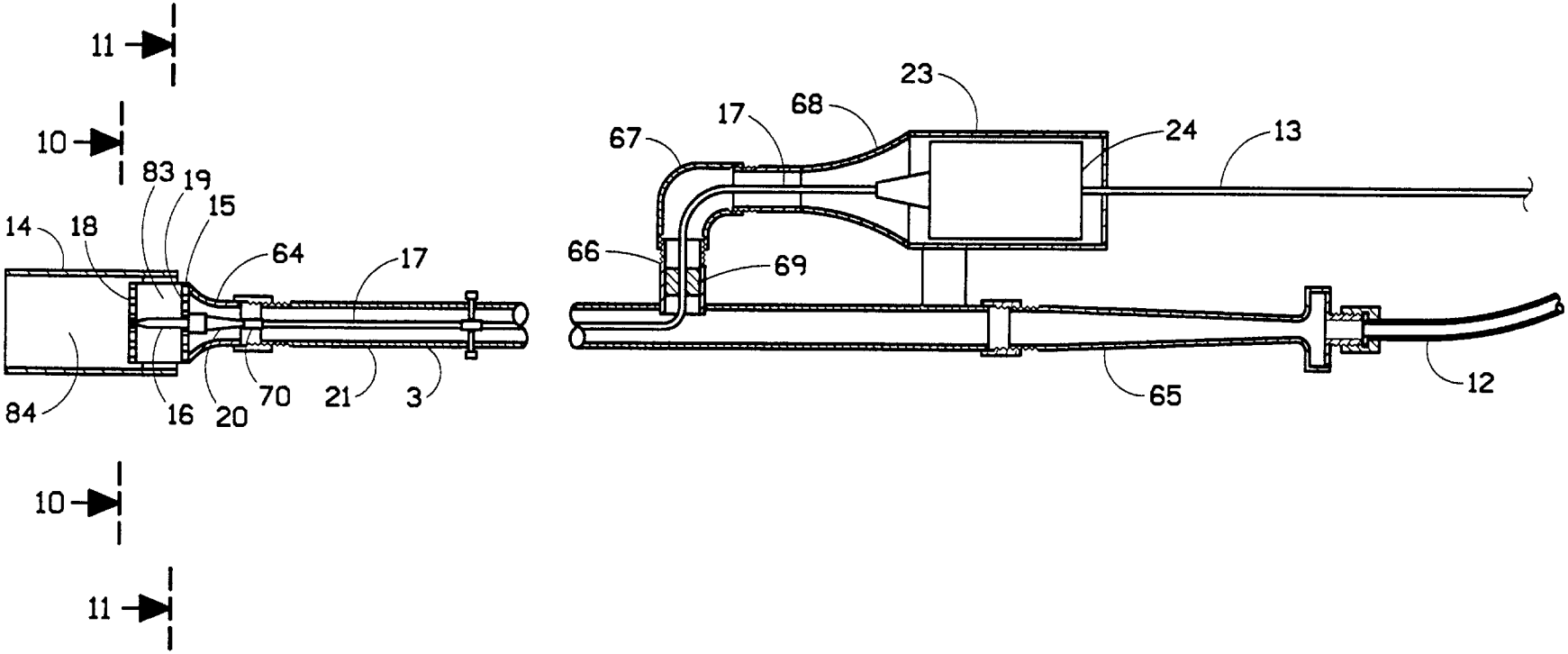
FIG. 9 is an elevation view of the spark ignited pilot.

Referring to FIG. 9 there is shown a section elevation view of the pilot assembly 3. The pilot assembly 3 is comprised of the pilot shield 14 with a first end that will be near the top of the flare stack, whereas the second end of the pilot shield 14 is fixed to the first end of a pilot nozzle 15. The second end of the pilot nozzle 15 is fixed to the first end of a reducer 64. The second end of the reducer 64 is fixed to the first end of the gas conductor 21. The second end of the gas conductor 21 is suitably fixed to the first end of an inspirator 65. The second end of the inspirator 65 is suitably fixed to the first end of a gas tube 12.

The first end of a pup section 66 of tubing is shown intersecting and fixed to the gas conductor 21 near the second end of the gas conductor 21. An elbow 67 is shown fixed to the second end of the pup section 66 at the first end of the elbow 67. The second end of the elbow 67 is shown suitably fixed to first end of a second reducer 68 by welding or other suitable means by design choice. The second end of the second reducer 68 is shown suitably fixed to the first end of a coil case 23. The first end of the ignition and control conductors 13 is shown suitably disposed in the coil case 23 and suitably connected to the second end of an ignition coil 24.

The second end of the high voltage rod 17 is shown suitably connected to the first end of the ignition coil 24 and is suitably disposed in the second reducer near the center of the second reducer 68 and is further disposed in the elbow 67 near the center axis of the elbow 67 wherein the high voltage rod is formed or bent to conform to the center axis configuration of the elbow 67 and wherein the high voltage rod 17 is further disposed in the pup section 66 and through a pup section seal 69 wherein the pup section seal 69 forms a gas tight seal between the gas conductor 21, the high voltage rod 17 in said pup section 66 and the inside surface of the pup section 66 thereby preventing any fuel gas from entering the pup section 66, the elbow 67 the second reducer 68 and the coil case 23. The pup section seal 69 also further prevents any air from entering into the gas conductor 21 from the pup section 66.

The high voltage rod 17 is formed or bent to intersect the central axis of the gas conductor 21 wherein the first end of the high voltage rod 17 is suitably connected to the high voltage coupling connector 70 at the second end of a high voltage coupling connector 70. The first end of the high voltage coupling connector 70 is shown suitably connected to the second end of a spark plug 20 wherein the first end of spark plug 20 is suitably connected to the second end of a high voltage electrode 16. The high voltage electrode 16 is disposed in the pilot nozzle 15 near the central axis of the pilot nozzle 15. A first nozzle plate 18 is shown near the first end of the pilot nozzle 15 and a second nozzle plate 19 is shown near the second end of the pilot nozzle 15. The space between the first nozzle plate 18 and the second nozzle plate 19 is an ignition chamber 83 wherein the combustion gas is ignited by the spark plug 20. The space between the pilot shield 14 and the first nozzle plate 18 is a combustion chamber 84 that acts as is a shield for the flames in windy conditions.

Figure 10:
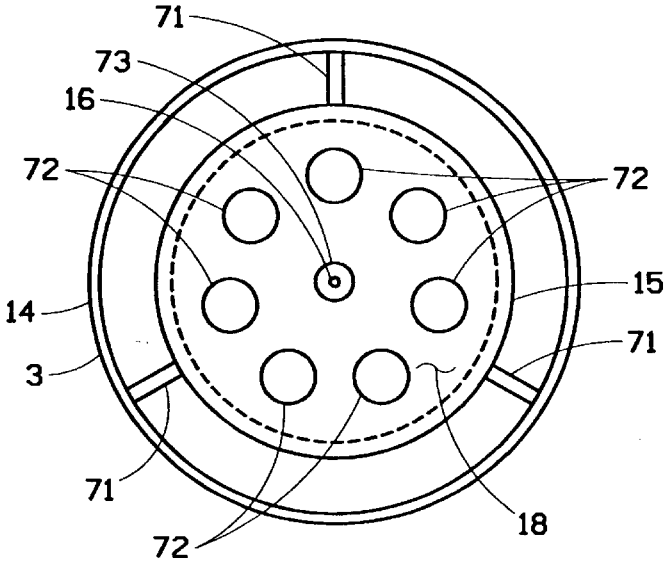
FIG. 10 is a section plan view of the pilot nozzle as taken through FIG. 9.

Referring to FIG. 10 there is shown a section plan view of the first end of the pilot nozzle 15 near the second end of the pilot shield 14 further showing the first plate 18.

The pilot shield 14 is shown on the outer circumference of the first end of the pilot assembly 3. Three support plates 71 are shown extending from the inside surface of the pilot shield 14 to the outside surface of the pilot nozzle 15. The support plates 71 are welded or fastened in another suitable manner to the pilot shield 14 and pilot nozzle 15.

Seven gas ports 72 are shown formed near the outer perimeter of the first nozzle plate 18. The number of gas ports 72 is determined by design choice. The gas ports 72 cause the gas and flame to be dispersed over a greater area than the area of only one port thereby ensuring a greater area of ignition and combustion. The greater number of gas ports 72 also assures a better opportunity of ignition from the high voltage electrode 16.

The high voltage electrode 16 is shown near a center axis and a center hole 73 that is formed in the first nozzle plate 18 and extends from the first side to the second side of the first nozzle plate 18.

Figure 11:
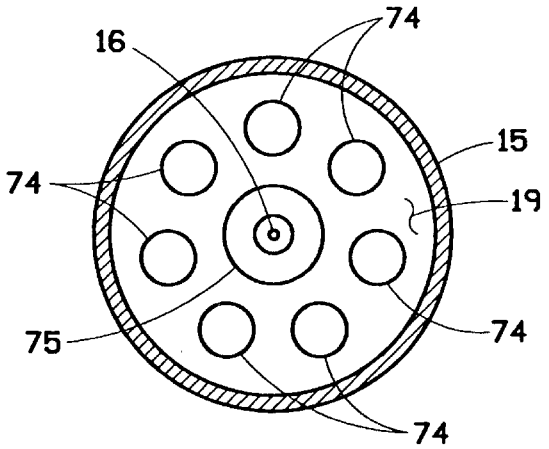
FIG. 11 is a section plan view of the pilot nozzle as taken through FIG. 9.

Referring to FIG. 11 there is shown a section plan view of the second nozzle plate 19 showing the outer and inner perimeter of the pilot nozzle 15. Seven lower gas ports 74 are shown that will disperse the gas within the pilot nozzle 15 and mix the gas with air prior to combustion. The number of lower gas ports 74 is determined by design choice. A second center hole 75 is shown formed in the second nozzle plate 19 that extends from the first side to the second side of the second nozzle plate 19. The second end of the high voltage electrode 16 is shown near the center axis of the pilot nozzle 15.

Figure 12:
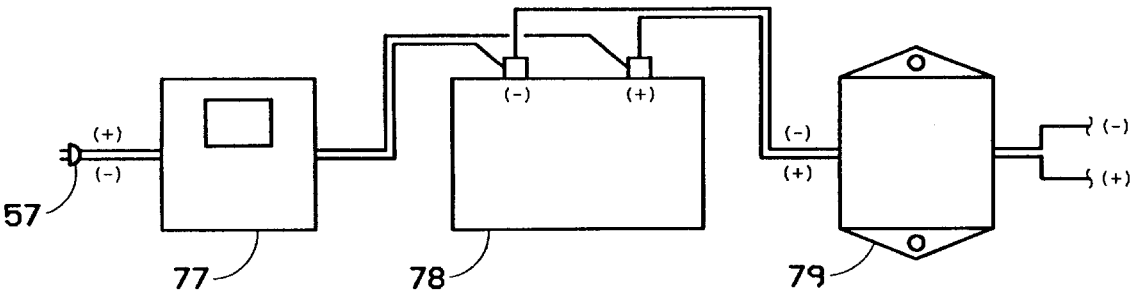
FIG. 12 is a control block diagram of the control and power source for the ignition system.

Referring to FIG. 12 there is shown a control block diagram of the electrical pulsed power source of the ignition system.

A power supply 57 is either an external line power or a suitable generator wherein the battery charger 77 is suitably energized. The battery charger 77 suitably chargers the battery 78 that sends sufficient electrical energy into the spark oscillator module 79 that sends the necessary electrical impulses into the ignition coil and spark plug causing a spark that ignites the gas that further ignites the gas in the flare stack.

Although the system described in detail supra has been found to be most satisfactory, many preferred variations are possible. Although the invention has been described with reference to the preferred embodiment, it will be understood by those skilled in the art that additions, modifications, substitutions, deletions and other changes not specifically described, may be made in the embodiment herein it should be understood that the details herein should be interpreted as illustrative and are not in a limiting sense.

What is claimed as invention is:

1. A retractable electric arc ignited gas pilot for igniting disposable gases and materials emissions on a flare stack with an upper end and a lower end comprising:

an upper support and guide assembly with an upper support frame wherein said upper support frame has a rectangular configuration with a first end, a second end, a third end, and a fourth end and an upper side;

a first 'U' bolt wherein said first 'U' bolt is fixed to said third end of said support frame and said 'U' bolt is disposed around said flare stack, wherein said 'U' bolt fixes said upper support frame to said flare stack;

a first cable support means wherein said first cable supports means' is fixed to said first end of said upper support frame;

a second cable support means wherein said second cable support means is fixed to said second end of said upper support frame and guide;

a pulley wherein said pulley is fixed to said fourth end of said upper support frame;

a winch foundation plate with a first end and a second end, an upper side and a lower side wherein said first end of said winch foundation plate is fixed to said flare stack near said lower end of said flare stack;

a winch bolt support plate with a first side and a second side wherein said first side of said winch support plate is fixed to said second end of said winch foundation plate;

a winch wherein said winch is fixed to said second side of said winch bolt support plate; and wherein said winch has a winch drum and a winch handle fixed to said winch drum;

a draw cable with a first end and a second end wherein said first end of said draw cable is fixed to said winch drum;

a tensioner beam with a first end, a second end, a first side and a second side wherein said second side of said tensioner beam is fixed to said upper side of said winch foundation plate;

a first guide cable with a first end and a second end wherein said first end of said first guide cable is fixed to said first end of said first cable support means and said second end of said first guide cable is fixed to said first end of said tensioner beam;

a second guide cable with a first end and a second end wherein said first end of said second guide cable is fixed to said second cable support means and said second end of said second guide cable is fixed to said second end of said tensioner beam;

a pilot carriage assembly with a first end, a second end, a third end, and an upper end wherein second end of said draw cable is fixed to said third end of said pilot carriage assembly;

a first carriage guide means with a first end and a second end and a hole formed between said first end and said second end of said first carriage guide means wherein said second end of said first carriage guide means is fixed to said first end of said pilot carriage assembly and wherein said first guide cable is deposed through said hole formed in said first carriage guide means;

a second carriage guide means with a first end and a second end and a hole formed in said second carriage guide means wherein said hole is formed between said first end and said second end of said second carriage guide means and wherein said second end of said second carriage guide means is fixed to said second end and said upper end of said carriage guide assembly and wherein said second guide cable is disposed through said hole formed in said second carriage guide means;

a pilot assembly with an upper end and a lower end;

a pilot shield with an upper end and a lower end wherein said pilot shield is a hollow tube and wherein said lower end of said pilot shield is fixed to said upper end of said pilot assembly;

a pilot nozzle with an upper end and a lower end wherein said upper end of said pilot nozzle is fixed to said lower end of said pilot shield;

a reducer with an upper end and a lower end wherein said upper end of said reducer is fixed to said lower end of said pilot nozzle;

a gas conductor with an upper end and a lower end wherein said upper end of said gas conductor is fixed to said lower end of said reducer;

an inspirator with an upper end and a lower end wherein said upper end of said inspirator is fixed to said lower end of said gas conductor;

a gas tube with an upper end and a lower end wherein said upper end of said gas tube is fixed to said lower end of said inspirator;

a pup section with a first end and a second end wherein said first end of said pup section is fixed to said gas conductor near said lower end of said gas conductor;

an elbow with a first end and a second end wherein said first end of said elbow is fixed to said second end of said pup section;

a second reducer with an upper end and a lower end wherein said upper end of said second reducer is fixed to said second end of said elbow;

a coil case with a first end and a second end wherein said first end of said coil case is fixed to said second end of said second reducer;

a first nozzle plate with a first side and a second side wherein said first nozzle plate is essentially round with an outer perimeter and wherein at least one gas port is formed near said outer perimeter and wherein at least one center hole is also formed in said first nozzle plate;

a second nozzle plate with a first side and a second side wherein said second nozzle plate is essentially round with an outer perimeter and wherein at least one gas port is formed near said outer perimeter and wherein at least on center hole is also formed in said second nozzle plate;

an electrical power source wherein said electrical power source supplies electrical energy;

a control module wherein said control module receives electrical energy from said electrical power source and further directs said electrical energy;

an ignition and control conductor wherein said electrical energy is further transmitted from said control module by means of said ignition and control conductor;

an ignition coil wherein said electrical energy from said ignition and control conductor is further transmitted;

a high voltage rod wherein said electrical energy is transmitted through said high voltage rod;

a spark plug wherein said spark plug converts said electrical energy into a spark;

a high voltage electrode wherein said high voltage electrode transmits said spark into said pilot nozzle;

a gas source wherein said combustible gas is supplied to said pilot assembly;

a gas tube with a first end and a second end wherein said second end of said gas tube is fixed to said gas source and said first end of said gas tube is fixed to said inspirator wherein said winch handle is turned thereby rotating said winch drum, and further winding said second end of said draw cable around said winch drum and thereby pulling said draw cable over said pulley and further pulling up said pilot carriage assembly fixed to said pilot assembly and further pulling up said pilot assembly wherein said pilot shield is located near said upper end of said flare stack wherein said combustible gas is thrust into said gas tube and into said gas conductor and further into said combustion chamber in said pilot shield wherein said modified electrical energy from said control module is induced into said ignition and control conductor wherein said modified electrical energy is further transmitted into said ignition coil further modifying said electrical energy into higher amperage wherein said higher amperage modified electricity is further induced into said high voltage rod wherein said higher amperage modified electricity is induced into said spark plug and said electricity arcs in said spark plug causing a spark further igniting said combustible gas in said combustion chamber and further igniting said waste gas exiting said top of said flare stack.

2. The retractable electrical arc-ignited combustible gas pilot for igniting waste gases and materials emissions on said flare stack of claim 1 wherein said pilot assembly may be lowered by rotating said winch handle thereby rotating said winch drum and further releasing said draw cable from said winch drum and further lowering said pilot carriage assembly and thereby lowering said pilot assembly for maintenance.

* * * * *